US008058792B2

(12) United States Patent
Seon et al.

(10) Patent No.: US 8,058,792 B2
(45) Date of Patent: Nov. 15, 2011

(54) LIGHT EMISSION DEVICE AND DISPLAY DEVICE INCLUDING SAME

(75) Inventors: Hyeong-Rae Seon, Yongin-si (KR); Jae-Young Lee, Yongin-si (KR); Dong-Su Chang, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 0 days.

(21) Appl. No.: 12/786,296

(22) Filed: May 24, 2010

(65) Prior Publication Data

US 2010/0295440 A1 Nov. 25, 2010

(30) Foreign Application Priority Data

May 25, 2009 (KR) ..... 10-2009-0045554

(51) Int. Cl.
*H01J 1/62* (2006.01)

(52) U.S. Cl. ..... 313/495; 313/497

(58) Field of Classification Search ..... 313/495–497, 313/493, 634
See application file for complete search history.

(56) References Cited

U.S. PATENT DOCUMENTS 6,787,983 B2 * 9/2004 Yamanobe et al. ..... 313/495
2007/0267963 A1 * 11/2007 Jun ..... 313/496

FOREIGN PATENT DOCUMENTS

JP 09-097559 4/1997
JP 2002-343285 11/2002
KR 10-0616617 B 8/2006

* cited by examiner

*Primary Examiner* — Vip Patel
(74) *Attorney, Agent, or Firm* — Christie, Parker & Hale, LLP

(57) ABSTRACT

A light emitting device capable of simplifying its manufacturing process and/or suppress vacuum leakage by improving its terminal structure and a display device having the same. The light emitting device includes a first substrate assembly, a second substrate assembly, and a sealing member for bonding the first substrate assembly with the second substrate assembly. The first substrate assembly includes a first substrate main body having recess portions, first electrodes within the recess portions, electron emission regions on the first electrodes, and second electrodes at a distance away from the electron emission regions and fixed to a surface of the first substrate assembly. Here, a first portion of the second electrode including a first end portion of the second electrode is exposed out of a region surrounded by the seal member and out of the seal member and is used as a terminal connected to an external circuit.

14 Claims, 10 Drawing Sheets

LIGHT EMISSION DEVICE AND DISPLAY DEVICE INCLUDING SAME

CROSS-REFERENCE TO RELATED APPLICATION

This application claims priority to and the benefit of Korean Patent Application No. 10-2009-0045554, filed in the Korean Intellectual Property Office on May 25, 2009, the entire content of which is incorporated herein by reference.

BACKGROUND

1. Field

The following description relates to a light emitting device and a display device having the same.

2. Description of Related Art

A light emitting device can emit light and include a front substrate having a phosphor layer and an anode thereon and a rear substrate having an electron emission region and driving electrodes thereon. The front substrate and the rear substrate form a vacuum chamber together with a sealing member by integrally bonding edges (or edge portions) thereof by the sealing member and exhausting the internal space. In the light emitting device, electrons that are emitted toward the front substrate from the electron emission region excite the phosphor layer, thereby emitting light.

In such a light emitting device, a terminal for applying a signal by an external circuit to driving electrodes is formed by a separate thick film and/or thin film process, and the terminal and the driving electrodes are electrically connected by various suitable bonding processes. However, in such a connection structure, because a separate thick film and/or thin film process and bonding process should be performed, its manufacturing method is relatively complicated and its manufacturing cost is relatively high.

In the above-described light emitting device, when the front substrate and the rear substrate are closely bonded by the sealing member and the inside of the vacuum chamber is at a high vacuum state, electron emission efficiency and life-span of the electron emission region can be improved. However, because the electron emission region and driving electrodes are formed on the rear substrate and a phosphor layer and an anode are formed on the front substrate, a bonding surface thereof that is formed may not be flat, and a portion in which bonding is formed with the sealing member may be inappropriate. In this case, because vacuum of the vacuum chamber may leak, the vacuum degree may be deteriorated.

The above information disclosed in this Background section is only for enhancement of understanding of the background of the invention and therefore it may contain information that does not form the prior art that is already known in this country to a person of ordinary skill in the art.

SUMMARY OF THE INVENTION

Aspects of embodiments of the present invention are directed toward a light emitting device capable of simplifying its manufacturing process and/or suppressing vacuum leakage by improving its terminal structure, and a display device having the same.

Aspects of embodiments of the present invention are directed toward a light emitting device including an improved terminal structure (with an improved seal structure) for connecting to an external circuit, and a display device having the same.

An exemplary embodiment of the present invention provides a light emitting device including a first substrate assembly, a second substrate assembly, and a sealing member between the first substrate assembly and the second substrate assembly. The sealing member is for bonding the first substrate assembly and the second substrate assembly with each other. The first substrate assembly includes a first substrate main body having recess portions, first electrodes within the recess portions, electron emission regions on the first electrodes, and second electrodes at a distance away from the electron emission regions and fixed to a surface of the first substrate assembly. The second substrate assembly includes a second substrate main body having a side facing the first substrate main body, and a light emitting unit on the side of the second substrate main body. Here, a first portion of each of the second electrodes is exposed out of a region surrounded by the seal member and out of the seal member and is configured to be utilized as a terminal for connecting to an external circuit.

In one embodiment, the sealing member includes a first adhesive layer on a first substrate side surface of the second electrodes and a second adhesive layer on a second substrate side surface of the second electrodes. The sealing member may further include a frame between the first substrate main body and the second substrate main body, and the second adhesive layer may bond the second electrodes with the frame. Both the first adhesive layer and the second adhesive layer may have substantially identical shape at along edge portions of the first substrate main body and the second substrate main body in a two-dimensional perspective. The sealing member may further include a third adhesive layer for bonding the frame with the second substrate main body.

In one embodiment, each of the second electrodes includes a second portion positioned within the region surrounded by the sealing member and a third portion corresponding to a region in which the sealing member is located, and a thickness of the third portion is smaller than that of at least one of the first portion or the second portion.

In one embodiment, each of the second electrodes includes a second portion positioned within the region surrounded by the sealing member and a third portion corresponding to a region in which the sealing member is located, and the third portion has at least one hole. The sealing member may have an adhesive layer for bonding the first substrate assembly with the second substrate assembly, and the adhesive layer may be filled within the at least one hole.

In one embodiment, each of the second electrodes includes a second portion positioned within the region surrounded by the sealing member and a third portion corresponding to a region in which the sealing member is located, and a width of the third portion is smaller than that of at least one of the first portion or the second portion. The third portion may have a groove portion formed at a side edge of the third portion.

In one embodiment, each of the second electrodes is composed of a metal plate, and wherein the second electrode has a mesh portion with openings for passing through electron beams and a support portion surrounding the mesh portion, and the first portion of the second electrode is formed with a part of the support portion.

In one embodiment, a second end portion of each of the second electrodes opposite to the first end portion is within the region surrounded by the sealing member.

In one embodiment, a second end portion of each of the second electrodes opposite to the first end portion is exposed out of the region surrounded by the sealing member and out of the sealing member.

Another embodiment of the present invention provides a display device including a light emitting device having above-described structure and a display panel that is positioned at the front of the light emitting device and that receives light from the light emitting device to display an image.

In the light emitting device according to embodiments of the present invention, because the first portion of the second electrode is exposed out of a region surrounded by the sealing member and out of the sealing member, it can be used as a terminal for connection to an external circuit, and a separate thick film and/or thin film process for forming the terminal and a bonding process for connecting the terminal and the electrode may not need to be performed. Accordingly, the manufacturing process can be simplified and the manufacturing cost and time can be reduced.

Further, by forming an adhesive layer in each of an upper part and a lower part of the second electrode, or by improving a structure of the second electrode in a portion corresponding to the sealing member, in a structure in which a terminal of the second electrode is drawn out to the outside and used, vacuum leakage can be effectively reduced or prevented.

The display device according to embodiments of the present invention can include the light emitting device as described above.

DETAILED DESCRIPTION

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

When it is stated that a first part, such as a layer, film, region, or plate, is positioned on a second part, it refers to that the first part is directly on the second part or on the second part with one or more intermediate parts therebetween. If a first part is stated to be positioned directly on a second part, it refers to that there is no intermediate part between the first and second parts.

A light emitting device according to a first exemplary embodiment of the present invention will be described in more detail with reference to FIGS. 1 to 4.

Figure 1:
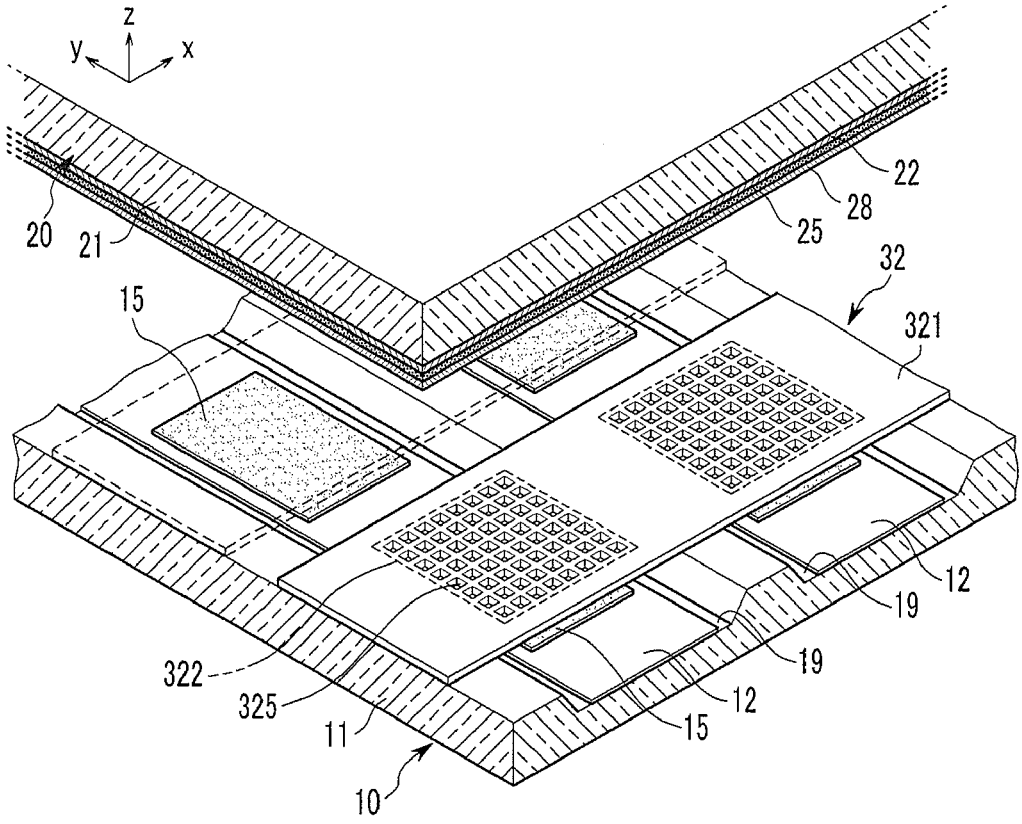
FIG. 1 is a partial perspective view of a light emitting device according to a first exemplary embodiment of the present invention.
Figure 2:
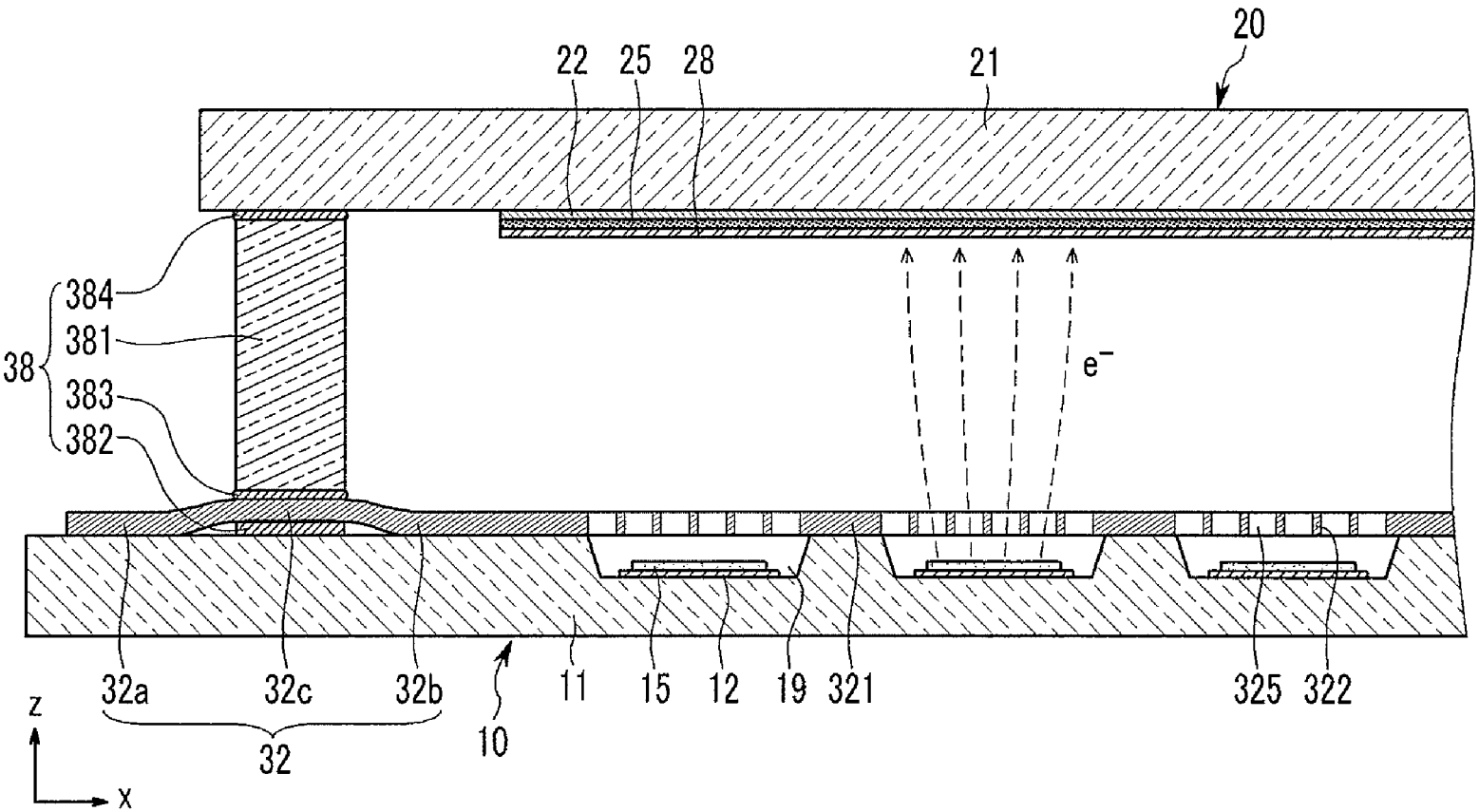
FIG. 2 is a partial cross-sectional view of a light emitting device according to the first exemplary embodiment of the present invention.

FIG. 1 is a partial perspective view of a light emitting device according to a first exemplary embodiment of the present invention, and FIG. 2 is a partial cross-sectional view of a light emitting device according to the first exemplary embodiment of the present invention.

Referring to FIGS. 1 and 2, the light emitting device 101 according to the present exemplary embodiment includes a vacuum chamber that is formed with a first substrate assembly 10 and a second substrate assembly 20 that are arranged opposite to each other (facing each other), and a sealing member 38 that is disposed between the first substrate assembly 10 and the second substrate assembly 20 to bond the substrate assemblies 10 and 20 together. The inside of the first substrate assembly 10, the second substrate assembly 20, and the sealing member 38 is exhausted to be in a vacuum state that sustains a vacuum degree of about $10^{-6}$ Torr.

The first substrate assembly 10 includes a first substrate (hereinafter, "first substrate main body") 11, a first electrode (hereinafter, "cathode") 12 that is formed on the substrate main body 11, an electron emission region 15, and a second electrode (hereinafter, "gate electrode") 32. Here, the cathodes 12 are formed to extend in a first direction (y-axis direction in the drawing) of the first substrate main body 11, and the gate electrodes 32 are formed to extend in a second direction crossing the first direction of the cathodes 12 (x-axis direction in the drawing) above the cathodes 12. In the drawings, the cathodes 12 and the gate electrodes 32 have a stripe shape, but the shape of the cathodes 12 and the gate electrodes 32 is not limited thereto, and the cathodes 12 and the gate electrodes 32 can have any suitable electrode shape that can control electron emission.

In an inner surface of the first substrate main body 11, recess portions 19 having a first depth D1 are formed in a stripe shape to extend in a length direction of the cathodes 12, and the cathodes 12 are positioned at a bottom surface of the recess portions 19. The recess portions 19 are formed by removing a part of the first substrate main body 11 using a method such as etching and/or sandblasting. The recess portion 19 may have a vertical side wall or an inclined side wall. In the drawings, the recess portion 19 having an inclined side wall is exemplified.

For example, the first substrate main body 11 may have a thickness of about 1.8 mm, and the recess portions 19 may have a depth of about 40 μm and a width of 300 μm to 600 μm.

Because the cathodes 12 are positioned at the bottom surface of the recess portions 19, the cathodes 12 are positioned lower by a set or predetermined height difference from a portion (barrier portion) at an inner surface of the first substrate main body 11 in which an upper surface, i.e., the recess portion 19 of the first substrate main body 11, is not formed. Therefore, the portion (the barrier portion) of the first substrate main body 11 that is positioned between the recess portions 19 functions as a wall for separating the neighboring cathodes 12.

The electron emission region 15 is formed on the cathode 12. FIG. 1 illustrates a case where the electron emission region 15 is formed only in a crossing region of the cathode 12 and the gate electrode 32, but the present invention is not limited thereto. Therefore, the electron emission region 15 may be formed in a stripe shape parallel to the cathode 12 and on the cathode 12.

The electron emission region 15 may include materials such as a carbon-based material and/or a nanometer size material that can emit electrons when an electric field is applied in a vacuum atmosphere. For example, the electron emission region 15 may include a material that is selected from a group consisting of carbon nanotubes, graphite, graphite nanofiber, diamond, diamond-like carbon, fullerene ($C_{60}$), silicone nanowire, and combinations thereof.

The electron emission region 15 is formed by a thick film process such as screen printing. That is, the electron emission region 15 is formed by sequentially performing a process of screen-printing a paste type mixture including an electron emission material on the cathode 12, a process of drying and baking the printed mixture, and a surface activation process of exposing electron emission materials on the surface of the electron emission region 15.

The surface activation process is performed by an operation of attaching and removing an adhesive tape on the electron emission region 15, and is performed before fixing the gate electrodes 32 on the first substrate main body 11. The electron emission materials such as a carbon nanotubes can be substantially vertically formed on a surface of the electron emission region 15 while removing a part of a surface of the electron emission region 15 through the surface activation process.

In the present exemplary embodiment, by forming a depth of the recess portion 19 to be greater than the sum of thicknesses of the cathode 12 and the electron emission region 15, the cathode 12 and the electron emission region 15 are positioned at a set or predetermined height from an upper surface of the first substrate main body 11.

The gate electrode 32 is manufactured with a metal plate having a set or predetermined thickness, for example a thickness greater than that of the cathode 12. The gate electrode 32 is formed with a mesh portion 322 in which openings 325 for passing through electron beams are formed, and a support portion 321 surrounding the mesh portion 322. For example, the gate electrode 32 may be manufactured through a step of forming the opening 325 by cutting a metal plate in a stripe shape and removing a part of a metal plate by a method such as etching.

In the present exemplary embodiment, as shown in FIG. 1, the mesh portion 322 of the gate electrode 32 is formed only in a crossing region with the cathode 12. Accordingly, by reducing line resistance of the gate electrode 32, a voltage drop can be reduced or minimized. However, the present invention is not limited thereto.

Therefore, in another exemplary embodiment, the mesh portion of the gate electrode 32 can be formed even in a portion that does not correspond to the cathode 12 as well as a portion corresponding to the cathode 12. In this case, because the region of the gate electrode 32 other than the two side end portions forms the mesh portion, when fixing the gate electrode 32 to the first substrate main body 11, it is unnecessary to consider alignment characteristics of the gate electrode 32 with the cathode 12 in a length direction (x-axis direction in the drawing) of the gate electrode 32.

The gate electrode 32 may be made of a nickel-iron alloy and/or other suitable metal materials, and may be formed with a thickness of about 50 μm and a width of about 10 μm.

In the light emitting device 101 of the above-described structure, one of crossing regions of the cathodes 12 and the gate electrodes 32 corresponds to one pixel area. Alternatively, two or more crossing regions may correspond to one pixel area, and in this case, the same driving voltage is applied to the cathodes 12 that are positioned at the same pixel area, and the same driving voltage is applied to the gate electrodes 32 that are positioned at the same pixel area.

Next, the second substrate assembly 20 is formed by forming a light emitting unit on a second substrate main body (hereinafter, "second substrate main body") 21. The light emitting unit includes an anode (anode electrode) 22 that is formed in an inner surface of the second substrate main body 21, a phosphor layer 25 that is positioned at one surface of the anode 22, and a reflective layer 28 that covers the phosphor layer 25.

The anode 22 is made of a transparent conducting material that can transmit visible light that is emitted from the phosphor layer 25. For example, the anode 22 may be made of a material such as indium tin oxide (ITO). The anode 22 is an acceleration electrode that pulls electron beams and sustains the phosphor layer 25 in a high potential state by receiving a positive DC voltage (anode voltage) of more than several thousand volts.

The phosphor layer 25 is formed with a mixed phosphor that emits white light by mixing red, green, and blue phosphors. The phosphor layer 25 may be formed in an entire light emitting area of the second substrate main body 21, or may be formed to be separated within each pixel area. FIGS. 1 and 2 illustrate a case where the phosphor layer 25 is formed in the entire light emitting area of the second substrate main body 21.

The reflective layer 28 that is formed on the phosphor layer 25 is formed with an aluminum thin film having a thickness of several thousands Å, and minute holes for passing through electron beams are formed in the reflective layer 28. The reflective layer 28 performs a function of increasing luminance of the light emitting device 101 by reflecting visible light that is emitted toward the first substrate 10 among visible light that is emitted from the phosphor layer 25.

Here, one of the anode 22 and the reflective layer 28 may be omitted. When the anode 22 is omitted, the reflective layer 28 receives an anode voltage to perform the same function as that of the anode 22.

A spacer that uniformly sustains a gap between both substrate assemblies 10 and 20 while withstanding a vacuum pressure is provided between the first substrate assembly 10 and the second substrate assembly 20. The spacers are positioned to correspond to the gate electrodes 32 therebetween.

In such a light emitting device 101, a scanning driving voltage is applied to the cathodes 12 or the gate electrodes 32, and a data driving voltage is applied to the other electrodes not applied with the scanning driving voltage. An anode voltage of more than several thousand volts is applied to the anode 22.

Accordingly, in pixels in which a voltage difference between the cathode 12 and the gate electrode 32 is a threshold value or more, an electric field is formed around the electron emission region 15 and thus electrons are emitted from the electron emission region 15. The emitted electrons are guided by an anode voltage that is applied to the anode 22 to collide with a corresponding portion of the phosphor layer 25, thereby allowing the phosphor layer 25 to emit light. Luminance of the phosphor layer 25 on a pixel basis corresponds to an electron beam emission amount of the corresponding pixel.

In the present exemplary embodiment, as the gate electrode 32 is disposed directly on the electron emission region 15, electrons that are emitted from the electron emission region 15 reach the phosphor layer 25 by passing through an opening 325 of the gate electrode 32 in a minimum or reduce beam spreading state. Therefore, in the light emitting device 101 according to the present exemplary embodiment, because an initial spreading angle of electron beams is reduced, charging of charges at a side wall of the recess portion 19 can be effectively suppressed.

As a result, by increasing withstanding voltage characteristics of the cathode 12 and the gate electrode 32, driving is stabilized, and thus by applying a high voltage of 10 kV or more, and in one embodiment, of 10 to 15 kV, to the anode 22, high luminance can be embodied.

Further, in the present exemplary embodiment, because a thick film process of forming an insulation layer and a thin film process of forming a gate electrode may be omitted, a manufacturing process can be simplified. In a case of forming an entire gate electrode with a mesh portion, when disposing the gate electrode 32 at the first substrate main body 11, it is unnecessary to consider an alignment state of the cathode 12.

Moreover, after the electron emission region 15 is formed, because the gate electrode 32 is disposed, in a process of forming the electron emission region 15, a problem that the cathode 12 and the gate electrode 32 are short-circuited by a conductive electron emission material can be prevented.

Figure 9:
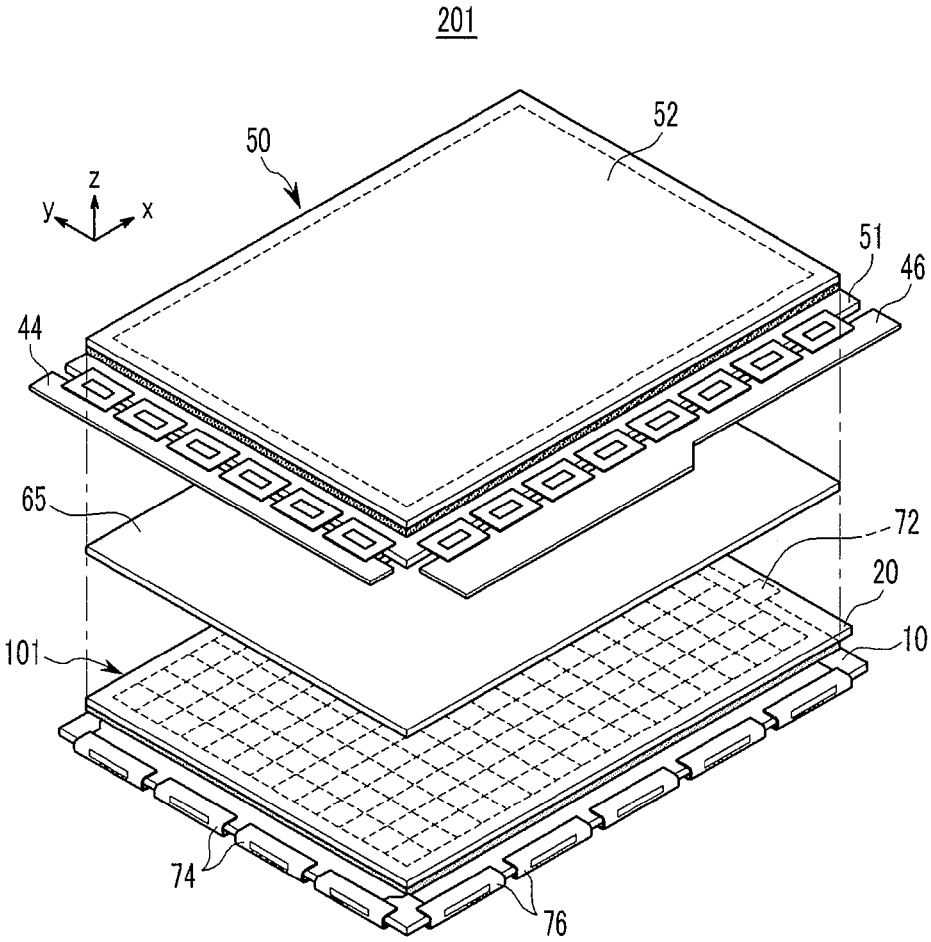
FIG. 9 is an exploded perspective view of a display device according to an exemplary embodiment of the present invention.

In the present exemplary embodiment, the first substrate 10 and the second substrate 20 are bonded by the sealing member 38, and a first portion 32*a* of the gate electrode 32 including the first end portion is exposed out of a region surrounded by the sealing member 38 and out of the sealing member 38 to be utilized as a terminal for connecting to an external circuit (for example, a second connector 74 of FIG. 9). Here, the first portion 32*a* is formed as a part of the support portion 321 of the gate electrode 32 in which an opening is not formed in order to connect to an external circuit.

In the present exemplary embodiment, by using the first portion 32*a* of the gate electrodes 32 as a terminal without forming a separate thick film or thin film electrode, the manufacturing process can be simplified and the manufacturing cost and time can be reduced.

In the present exemplary embodiment, by forming an adhesive layer for bonding the first substrate assembly 10 and the second substrate assembly 20 in both an upper part and a lower part of the gate electrode 32, vacuum leakage that may occur while the first portion 32*a* of the gate electrode 32 is exposed to the outside can be suppressed.

In more detail, in the present exemplary embodiment, the sealing member 38 includes a frame 381 that is positioned between the first substrate main body 11 and the second substrate main body 21, a first adhesive layer 382 that bonds the first substrate main body 11 and the gate electrodes 32 therebetween, a second adhesive layer 383 that bonds the gate electrodes 32 and the frame 381 therebetween, and a third adhesive layer 384 that bonds the frame 381 and the second substrate main body 21 therebetween.

In order to sustain vacuum, the frame 381 constituting part of the sealing member 38, the first adhesive layer 382, the second adhesive layer 383, and the third adhesive layer 384 are formed in the same shape along edges (in edge portions) of the first and second substrate main bodies 11 and 21 as seen two-dimensionally (i.e., in a two-dimensional perspective).

Accordingly, the first adhesive layer 382 is positioned at a lower part of the gate electrode 32, the second adhesive layer 383 is positioned at an upper part of the gate electrode 32, and space between the gate electrodes 32 is filled with the first and second adhesive layers 382 and 383. In this way, because the first and second adhesive layers 382 and 383 are formed while enclosing the gate electrodes 32, even if the first portion 32*a* of the gate electrode 32 is drawn out to the outside, vacuum leakage can be effectively reduced or prevented.

Figure 3:
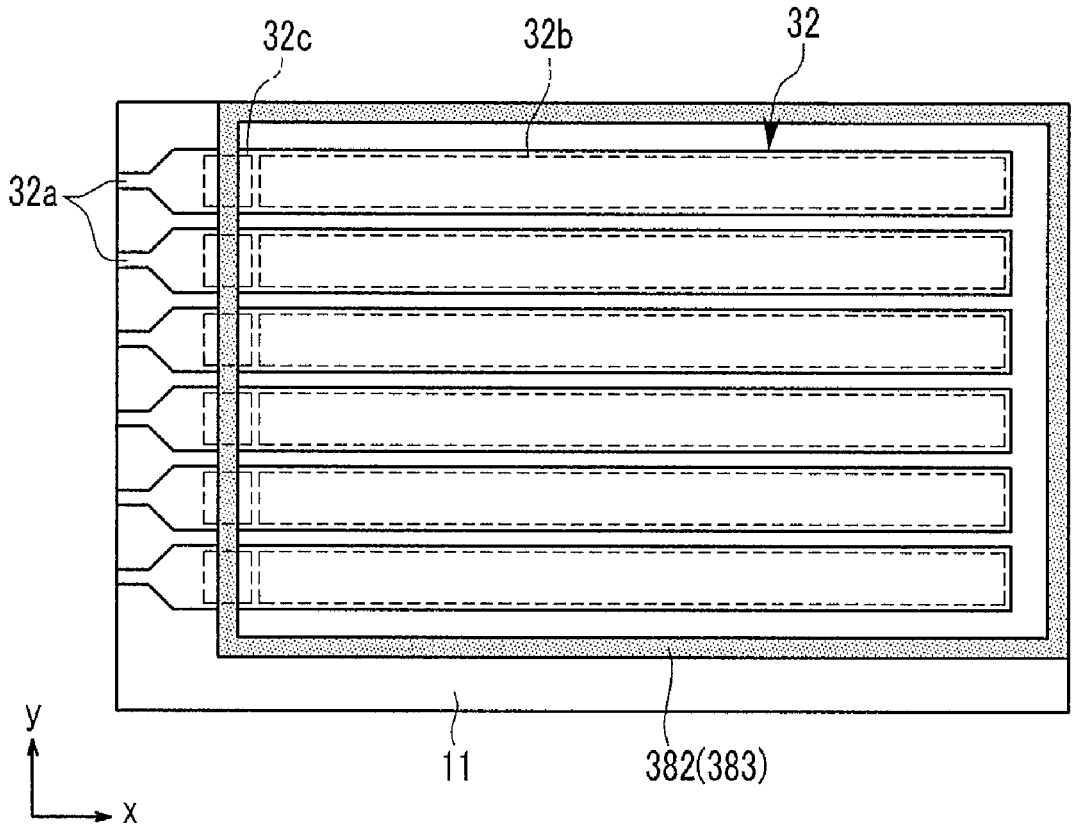
FIG. 3 is a top plan view illustrating a first substrate main body, a first adhesive layer, a second adhesive layer, and gate electrodes of a light emitting device according to the first exemplary embodiment of the present invention.

In the present exemplary embodiment, the first adhesive layer 382, the second adhesive layer 383, and the gate electrodes 32 will be described in more detail with reference to FIG. 3. FIG. 3 is a top plan view illustrating the first substrate main body 11, the first adhesive layer 382, the second adhesive layer 383, and the gate electrodes 32 of the light emitting device according to the first exemplary embodiment of the present invention.

As shown in FIG. 3, the gate electrodes 32 include the first portion 32*a* utilized as a terminal, a second portion 32*b* that is positioned within a region surrounded by a sealing member (38 of FIG. 2), i.e., the first adhesive layer 382 and the second adhesive layer 383, and a third portion 32*c* that is positioned at a portion in which the first adhesive layer 382 and the second adhesive layer 383 are formed.

In this case, in the present exemplary embodiment, a second end portion (right end portion in the drawings) of the gate electrodes 32 is positioned within the region surrounded by the first adhesive layer 382 and the second adhesive layer 383. In this case, only the third portion 32*c* that is formed at the first end portion side of the gate electrode 32 is fixed to the first substrate main body 11 by the first and second adhesive layers 382 and 383, and the second end portion of the gate electrode 32 is simply put on the first substrate main body 11. In this case, because the second end portion of the gate electrode 32 is not exposed to the outside, this helps in sustaining high vacuum.

Figure 4:
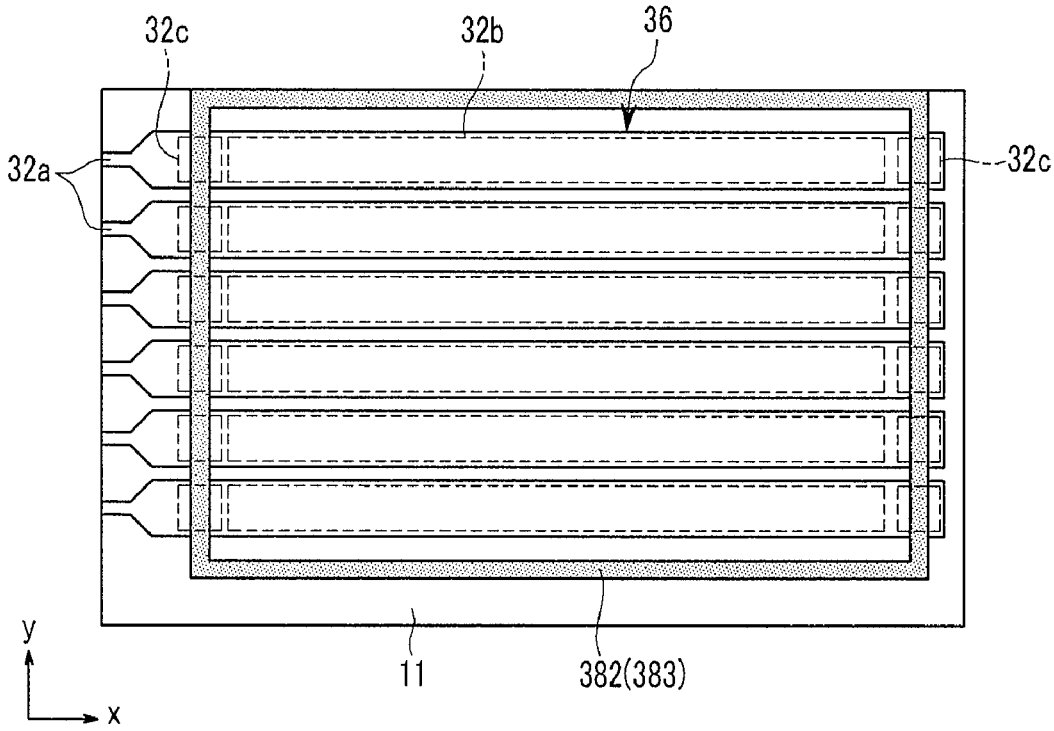
FIG. 4 is a top plan view illustrating a first substrate main body, a first adhesive layer, a second adhesive layer, and gate electrodes of a light emitting device according to an exemplary variation of the first exemplary embodiment of the present invention.

As shown in FIG. 4, in an exemplary variation of the present exemplary embodiment, the first adhesive layer 382 and the second adhesive layer 384 are formed to cross the vicinity of a second end portion of gate electrodes 36 and the third portion 32*c* may be formed at the vicinity of the second end portion of the gate electrodes 36. In this case, only the third portions 32*c* of the gate electrode 36 are fixed on the first substrate main body 11 at both end portions of the gate electrode 36, and the remaining portions are disposed on the first substrate main body 11. In the present exemplary variation, the gate electrode can be more firmly fixed by fixing both end portions of the gate electrode 36 to the first substrate main body 11.

Hereinafter, a light emitting device according to second to fourth exemplary embodiments of the present invention will be described with reference to FIGS. 5 to 8. In the following descriptions of further exemplary embodiments, constituent elements that are identical to or correspond to those of the first exemplary embodiment are denoted by the same reference numerals, and therefore detailed descriptions thereof will not be provided again. Further, the exemplary variation of the first exemplary embodiment can be applied to the second to fourth exemplary embodiments.

Figure 5:
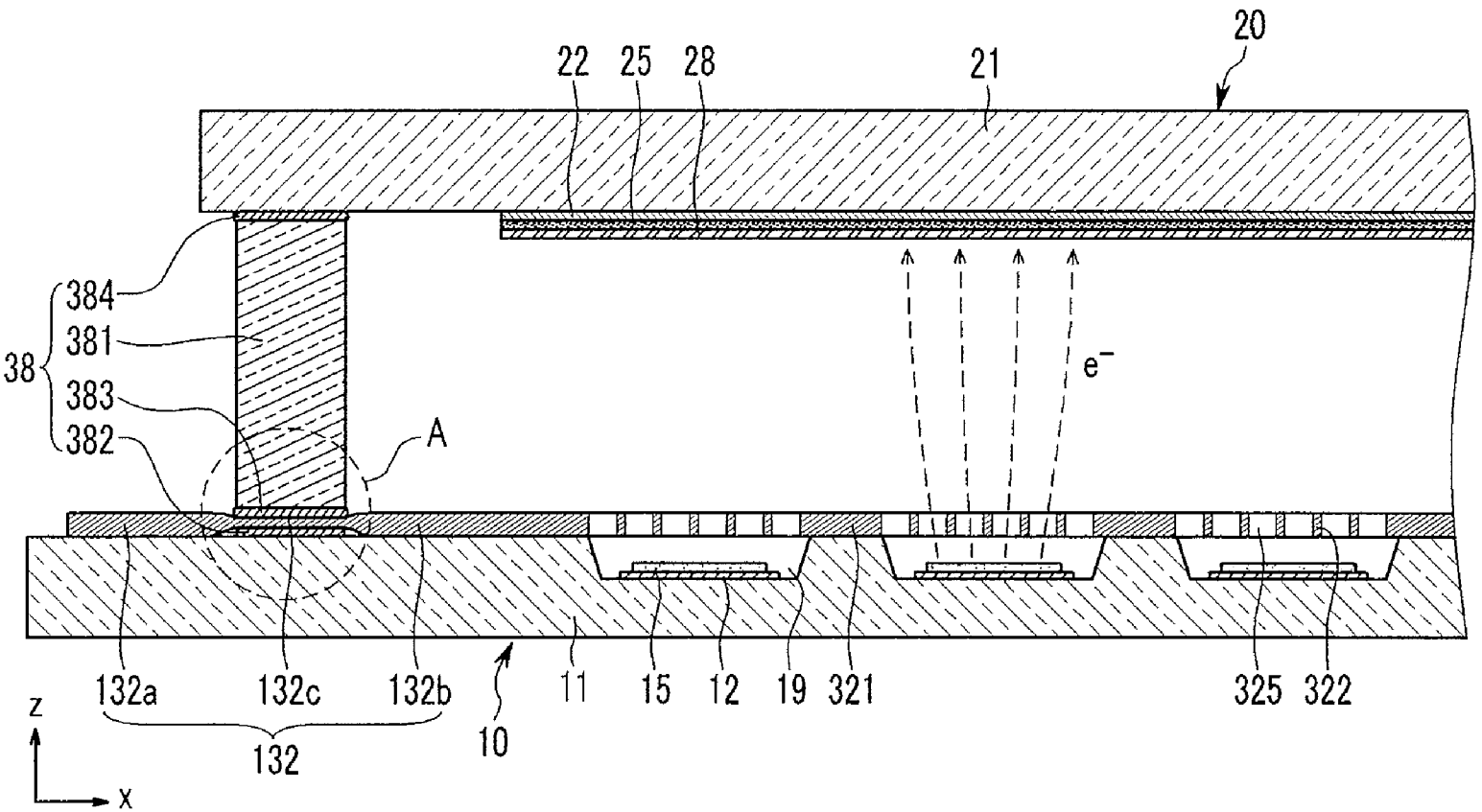
FIG. 5 is a partial cross-sectional view of a light emitting device according to a second exemplary embodiment of the present invention.
Figure 6:
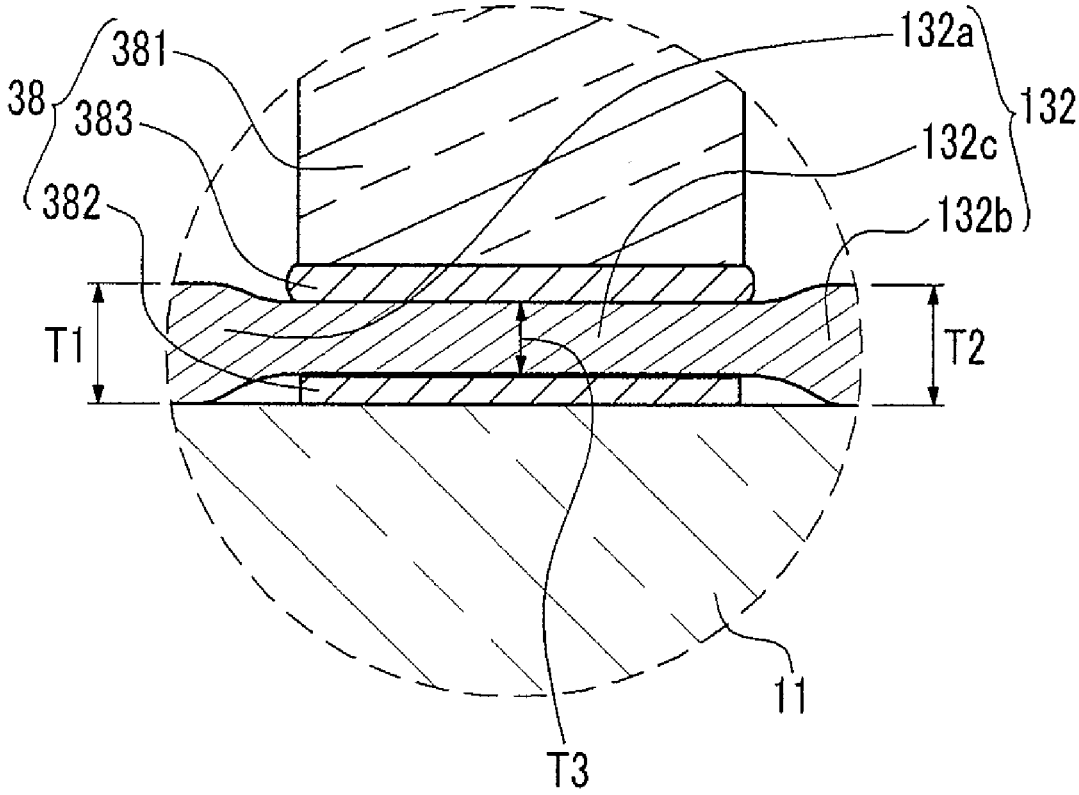
FIG. 6 is a partially enlarged view of a portion A of FIG. 5.

FIG. 5 is a partial cross-sectional view of a light emitting device according to a second exemplary embodiment of the present invention, and FIG. 6 is a partially enlarged view of a portion A of FIG. 5.

As shown in FIGS. 5 and 6, in the present exemplary embodiment, a thickness T3 of a third portion 132*c* of a gate electrode 132 corresponding to the sealing member 38 is formed smaller than a thickness T1 of a first portion 132*a* and a thickness T2 of a second portion 132*b* of the gate electrode 132. If the thickness T1 of the first portion 132*a* increases, space corresponding to the thickness T1 thereof may be formed between gate electrodes 132, and the space may cause vacuum leakage. Therefore, in the present exemplary embodiment, by thinly forming the thickness T1 of the first portion 132*a*, vacuum leakage can be effectively reduced or prevented.

In the present exemplary embodiment, by forming a first adhesive layer 382 in a lower part of the third portion 132*c*, i.e., on a surface opposite to (or facing) the first substrate main body 11, and by forming a second adhesive layer 383 in an upper part thereof, i.e., on a surface opposite to a second substrate main body 21, space between the third portions 132*c* of neighboring gate electrodes 132 is filled (enclosed) by an adhesive layer. Accordingly, vacuum leakage can be more effectively suppressed. However, the present invention is not limited thereto, and the gate electrode 132 may be fixed to the first substrate main body 11 by a bonding force and/or a compressive force of the sealing member 38 without the first adhesive layer 382.

Further, in the drawings, the thickness T1 of the first portion 132*a* and the thickness T2 of the second portion 132*b* are substantially identical, and the thickness T3 of the third portion 132*c* is smaller than the thickness T1 and the thickness T2, but the present invention is not limited thereto. That is, as long as the thickness T3 of the third portion 132*c* is smaller than one of the thickness T1 of the first portion 132*a* or the thickness T2 of the second portion 132*b*, it can suppress vacuum leakage.

Figure 7:
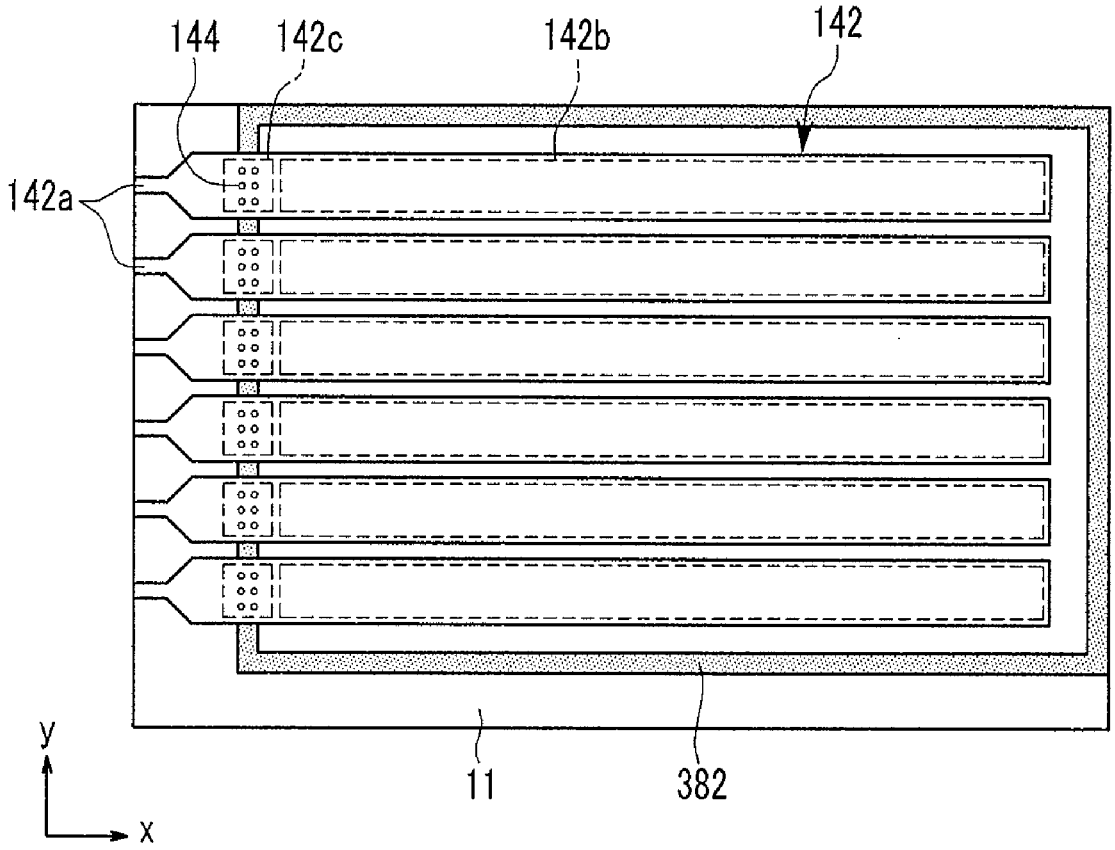
FIG. 7 is a top plan view illustrating a first substrate main body, a first adhesive layer, and gate electrodes of a light emitting device according to a third exemplary embodiment of the present invention.

FIG. 7 is a top plan view illustrating a first substrate main body, a first adhesive layer, and gate electrodes of a light emitting device according to a third exemplary embodiment of the present invention.

As shown in FIG. 7, in the present exemplary embodiment, at least one hole 144 is formed in a third portion 142*c* of a gate electrode 142, and a first adhesive layer 382 of a sealing member (38 of FIG. 2, hereinafter, the same reference numeral) is filled within the hole 144. Accordingly, because bonding characteristics between the third portion 142*c* and the first substrate main body 11 and between the third portion 142*c* and the frame (381 of FIG. 2, hereinafter, the same reference numeral) are improved, vacuum leakage can be effectively reduced or prevented.

In the present exemplary embodiment, by forming the first adhesive layer 382 in a lower part of the third portion 142*c* and forming the second adhesive layer (383 of FIG. 2, hereinafter, the same reference numeral) in an upper part thereof, space between the third portions 142*c* of the neighboring gate electrodes 142 is filled with an adhesive layer. Because the first adhesive layer 382 and the second adhesive layer 383 are connected within the hole 144, a vacuum leakage prevention effect can be further improved. However, the present invention is not limited thereto, and the gate electrode 142 may be fixed to the first substrate main body 11 by a bonding force and/or a compressive force of the sealing member 38 without the first adhesive layer 382.

Figure 8:
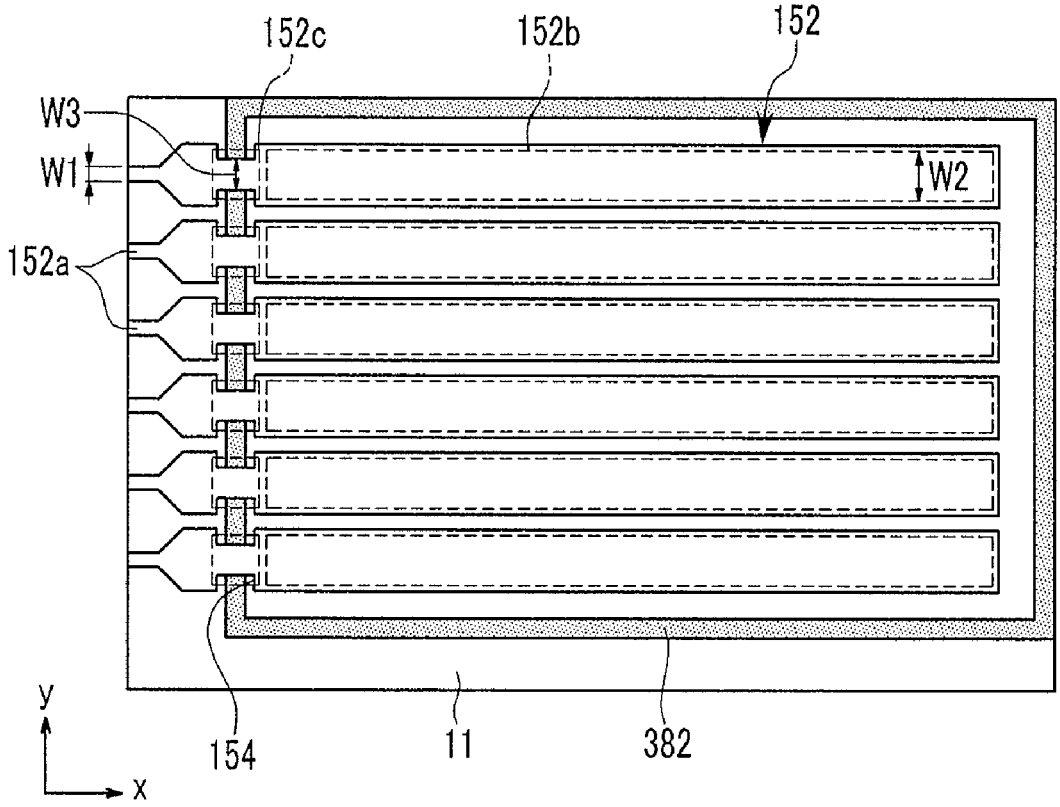
FIG. 8 is a top plan view illustrating a first substrate main body, a first adhesive layer, and gate electrodes of a light emitting device according to a fourth exemplary embodiment of the present invention.

FIG. 8 is a top plan view illustrating a first substrate main body, a first adhesive layer, and gate electrodes of a light emitting device according to a fourth exemplary embodiment of the present invention.

As shown in FIG. 8, as a groove portion 154 is formed at the edges (side edges) of both sides of a third portion 152*c* of a gate electrode 152, a width W3 of the third portion 152*c* is formed smaller than a width W2 of a second portion 152*b*. Accordingly, high vacuum is sustained between a first substrate 10 and a second substrate 20 by widening an area of a portion that is bonded by the first adhesive layer 382 and a second adhesive layer 383.

In the present exemplary embodiment, by forming the first adhesive layer 382 in a lower part of the third portion 152*c* and forming the second adhesive layer 383 in an upper part thereof, space between the third portions 152*c* of the neighboring gate electrodes 152 is filled (enclosed) by the adhesive layers 382 and 383. Accordingly, vacuum leakage can be more effectively suppressed. However, the present invention is not limited thereto, and the gate electrode 152 may be fixed to the first substrate main body 11 by a bonding force and/or a compressive force of the sealing member 38 without the first adhesive layer 382.

Further, in the drawings, the width W3 of the third portion 152*c* is formed smaller than the width W2 of the second portion 152*b* and is formed greater than the minimum width W1 of a first portion 152*a*, but the present invention is not limited thereto. That is, as long as the width W3 of the third portion 152*c* is smaller than one of the minimum width W1 of the first portion 152*a* or the width W2 of the second portion 152*b*, vacuum leakage can be prevented or reduced.

Hereinafter, a display device according to an exemplary embodiment of the present invention will be described with reference to FIGS. 9 and 10.

FIG. 9 is an exploded perspective view of a display device according to an exemplary embodiment of the present invention.

A display device 201 according to the present exemplary embodiment includes a light emitting device 101 and a display panel 50 that is positioned at the front of the light emitting device 101. The light emitting device 101 is a light emitting device of one of the above-described exemplary embodiments, and functions as a light source in the display device 201. The display panel 50 may be a transmissive or transflective liquid crystal display panel. A diffusion member 65 that evenly diffuses light that is emitted from the light emitting device 101 is positioned between the light emitting device 101 and the display panel 50.

Figure 10:
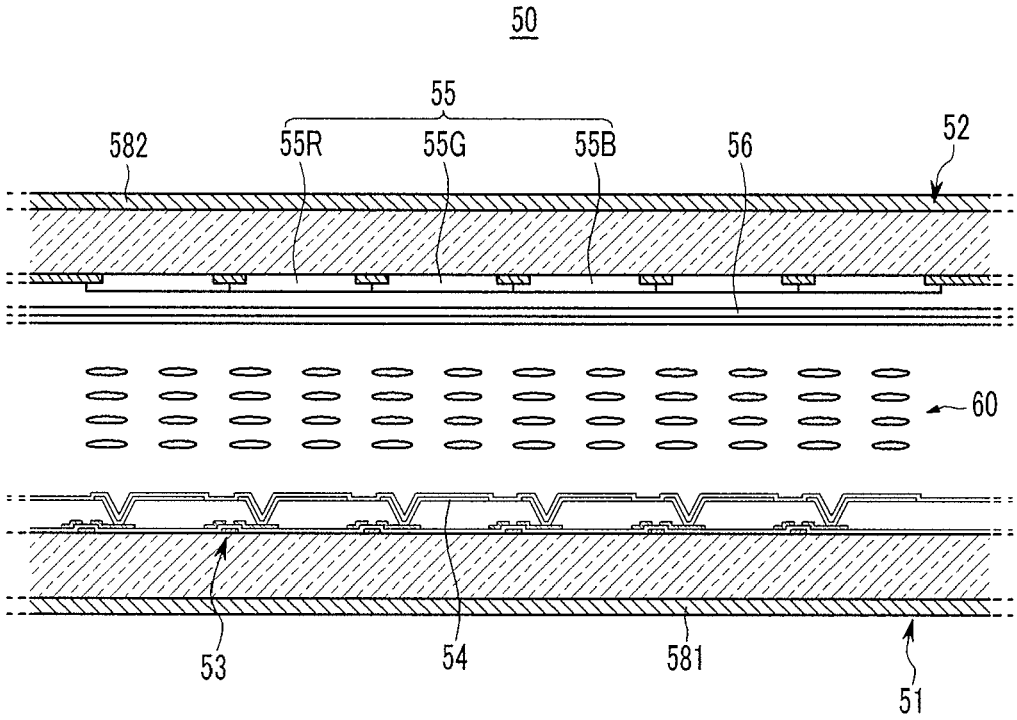
FIG. 10 is a partial cross-sectional view of a display panel that is shown in FIG. 9.

FIG. 10 is a partial cross-sectional view of the display panel 50 that is shown in FIG. 9, and exemplifies a transmissive liquid crystal display panel. A case where the display panel 50 is a transmissive liquid crystal display panel is described with reference to FIG. 10.

Referring to FIG. 9, the display panel 50 includes a first display panel 51 in which a thin film transistor (TFT) 53 and a pixel electrode 54 are formed, a second display panel 52 in which a color filter layer 55 and a common electrode 56 are formed, and a liquid crystal layer 60 that is injected between the first display panel 51 and the second display panel 52. Polarizing plates 581 and 582 are respectively attached to a front surface of the first display panel 51 and a rear surface of the second display panel 52 to polarize light that passes through the display panel 50.

The pixel electrodes 54 are positioned one by one in each subpixel, and driving thereof is controlled by the TFT 53. Here, a plurality of subpixels that embody different colors form a pixel, and the pixel becomes a minimum unit that displays an image. The pixel electrodes 54 and the common electrode 56 are made of a transparent conducting material. The color filter layer 55 includes a red filter layer 55R, a green filter layer 55G, and a blue filter layer 55B that are each positioned on a subpixel basis.

Particularly, when the TFT 53 of the subpixel is turned on, an electric field is formed between the pixel electrode 54 and the common electrode 56. An alignment angle of liquid crystal molecules of the liquid crystal layer 60 is changed by the electric field, and a light transmittance changes according to the changed alignment angle of liquid crystal molecules. The display panel 50 controls luminance on a pixel basis and a light emitting color through such a process, thereby displaying an image.

The display panel 50 is not limited to the above-described structure, and can be formed to various suitable structures.

Referring to FIGS. 9 and 10, the display device 201 includes a gate circuit board 44 that supplies a gate driving signal to a gate electrode of each TFT 53 of the display panel 50, and a data circuit board 46 that supplies a data driving signal to a source electrode of each TFT 53 of the display panel 50.

The light emitting device 101 allows a pixel of the light emitting device 101 to correspond to two or more pixels of the display panel 50 by forming pixels of a smaller number than that of the display panel 50. Each pixel of the light emitting device 101 can light emit to correspond to gray levels of pixels of the display panel 50 corresponding thereto, and for example, can emit light to correspond to a highest gray level of the gray levels of pixels of the display panel 50 corresponding thereto. Each pixel of the light emitting device 101 can represent gray levels in a grayscale of 2 to 8 bits.

For convenience, a pixel of the display panel 50 is referred to as a "first pixel", a pixel of the light emitting device 101 is referred to as a "second pixel", and first pixels corresponding to a second pixel are referred to as a "first pixel group".

A driving process of the light emitting device 101 includes allowing a signal controller that controls the display panel 50 to detect a highest gray level of the first pixels of the first pixel group, calculating a gray level necessary for emitting light of the second pixel according to the detected gray level, and converting the calculated gray level to digital data, generating a driving signal of the light emitting device 101 using the digital data, and applying the generated driving signal to a driving electrode of the light emitting device 101.

The driving signal of the light emitting device 101 includes a scan signal and a data signal. One (for example a gate electrode) of the cathode (12 of FIG. 1, hereinafter, the same reference numeral) or the gate electrode (32 of FIG. 1, hereinafter, the same reference numeral) receives a scan signal, and the other electrode (for example a cathode) receives a data signal.

Further, a data circuit board and a scanning circuit board for driving the light emitting device 101 are disposed at a rear surface of the light emitting device 101. The data circuit board and the scanning circuit board are connected to the cathode 12 and the gate electrode 32 through a first connector 76 and a second connector 74, respectively. In this case, the second connector 74 is connected to a first portion 32*a* of the gate electrode 32 that is exposed out of a region surrounded by the sealing member and out of the sealing member. A third connector 72 applies an anode voltage to the anode 22.

In this way, when an image is displayed in the corresponding first pixel group, the second pixel of the light emitting device 101 is synchronized with the first pixel group to emit light with a set or predetermined gray level. That is, the light emitting device 101 provides light of high luminance to a bright region of a screen that is embodied by the display panel 50 and provides light of low luminance to a dark region thereof. Therefore, the display device 201 according to the present exemplary embodiment can increase a contrast ratio of a screen and embody clearer image quality.

By such a configuration, the display device 201 can include the light emitting device 101 that can extend the life-span thereof by reducing or preventing vacuum leakage.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A light emitting device comprising:

a first substrate assembly comprising:

a first substrate main body having recess portions, first electrodes within the recess portions, electron emission regions on the first electrodes, and second electrodes at a distance away from the electron emission regions and fixed to a surface of the first substrate assembly;

a second substrate assembly comprising:

a second substrate main body having a side facing the first substrate main body, and a light emitting unit on the side of the second substrate main body; and a sealing member between the first substrate assembly and the second substrate assembly, the sealing member being for bonding the first substrate assembly and the second substrate assembly with each other, wherein a first portion of each of the second electrodes is exposed out of a region surrounded by the seal member and out of the seal member and is configured to be utilized as a terminal for connecting to an external circuit.

2. The light emitting device of claim 1, wherein the sealing member comprises a first adhesive layer on a first substrate facing side surface of the second electrodes and a second adhesive layer on a second substrate facing side surface of the second electrodes.

3. The light emitting device of claim 2, wherein the sealing member further comprises a frame between the first substrate main body and the second substrate main body, and wherein the second adhesive layer bonds the second electrodes with the frame.

4. The light emitting device of claim 2, wherein both the first adhesive layer and the second adhesive layer have substantially identical shape at along edge portions of the first substrate main body and the second substrate main body in a two-dimensional perspective.

5. The light emitting device of claim 3, wherein the sealing member further comprises a third adhesive layer for bonding the frame with the second substrate main body.

6. The light emitting device of claim 1, wherein each of the second electrodes comprises a second portion positioned within the region surrounded by the sealing member and a third portion corresponding to a region in which the sealing member is located, and wherein a thickness of the third portion is smaller than that of at least one of the first portion or the second portion.

7. The light emitting device of claim 1, wherein each of the second electrodes comprises a second portion positioned within the region surrounded by the sealing member and a third portion corresponding to a region in which the sealing member is located, and wherein the third portion has at least one hole.

8. The light emitting device of claim 7, wherein the sealing member has an adhesive layer for bonding the first substrate assembly with the second substrate assembly, and wherein the adhesive layer is filled within the at least one hole.

9. The light emitting device of claim 1, wherein each of the second electrodes comprises a second portion positioned within the region surrounded by the sealing member and a third portion corresponding to a region in which the sealing member is located, and wherein a width of the third portion is smaller than that of at least one of the first portion or the second portion.

10. The light emitting device of claim 9, wherein the third portion has a groove portion formed at a side edge of the third portion.

11. The light emitting device of claim 1, wherein each of the second electrodes is composed of a metal plate, and wherein the second electrode has a mesh portion with openings for passing through electron beams, and a support portion surrounding the mesh portion, and wherein the first portion of the second electrode is formed with a part of the support portion.

12. The light emitting device of claim 1, wherein the first portion comprises a first end portion, and wherein a second end portion of each of the second electrodes opposite to the first end portion is within the region surrounded by the sealing member.

13. The light emitting device of claim 1, wherein the first portion comprises a first end portion, and wherein a second end portion of each of the second electrodes opposite to the first end portion is exposed out of the region surrounded by the sealing member and out of the sealing member.

14. A display device comprising:

a light emitting device comprising:

a first substrate assembly comprising:

a first substrate main body having recess portions, first electrodes within the recess portions, electron emission regions on the first electrodes, and second electrodes at a distance away from the electron emission regions and fixed to a surface of the first substrate assembly;

a second substrate assembly comprising:

a second substrate main body having a side facing the first substrate main body, and a light emitting unit on the side of the second substrate main body; and a sealing member between the first substrate assembly and the second substrate assembly, the sealing member being for bonding the first substrate assembly and the second substrate assembly with each other, wherein a first portion of each of the second electrodes is exposed out of a region surrounded by the seal member and out of the seal member and is configured to be utilized as a terminal for connecting to an external circuit; and a display panel configured to receive light from the light emitting device and to display an image with the received light.

* * * * *